US009743763B1

(12) United States Patent
Ordovas

(10) Patent No.: US 9,743,763 B1
(45) Date of Patent: Aug. 29, 2017

(54) KITCHEN TRAY ASSEMBLY

(71) Applicant: Long Term Venture Capital Ltd., Hong Kong (CN)

(72) Inventor: Jonathan Ordovas, Windsor (GB)

(73) Assignee: Long Term Venture Capital Ltd., Hong Kong (CN)

( * ) Notice: Subject to any disclaimer, the term of this patent is extended or adjusted under 35 U.S.C. 154(b) by 0 days.

(21) Appl. No.: 15/086,088

(22) Filed: Mar. 31, 2016

(51) Int. Cl.
*A47B 51/00* (2006.01)
*A47B 77/04* (2006.01)

(52) U.S. Cl.
CPC ..... *A47B 77/04* (2013.01); *A47B 51/00* (2013.01); *A47B 2051/005* (2013.01); *A47B 2220/0097* (2013.01)

(58) Field of Classification Search
CPC .... A47B 77/04; A47B 2051/005; A47B 51/00
USPC ..... 312/271, 272, 273
See application file for complete search history.

(56) References Cited

U.S. PATENT DOCUMENTS 2,687,934 A * 8/1954 Gipple ..... A47B 1/04 312/272
5,586,816 A * 12/1996 Geiss, II ..... A47B 51/00 312/301
6,755,492 B1 * 6/2004 Hyde ..... A47B 51/00 312/247
8,414,093 B2 * 4/2013 Moran ..... A47B 51/00 312/246
8,424,983 B1 * 4/2013 Strauss ..... A47B 51/00 312/247
8,641,156 B2 * 2/2014 Chow ..... A47B 51/00 312/247
8,899,701 B2 * 12/2014 Walker ..... A47B 77/08 312/306
2016/0081470 A1 * 3/2016 Lemon ..... A47B 51/00 312/237

FOREIGN PATENT DOCUMENTS

| | | | | |
|---|---|---|---|---|
| CN | 2902018 | | 5/2007 | |
| CN | 101263068 | | 9/2008 | |
| CN | 203885023 | | 10/2014 | |
| CN | 105212596 | | 1/2016 | |
| GB | 2061700 | A * | 5/1981 | A47B 51/00 |
| GB | 2078651 | | 1/1982 | |
| WO | 2013119782 | | 8/2013 | |

* cited by examiner

*Primary Examiner* — Thomas Randazzo
(74) *Attorney, Agent, or Firm* — Eagle IP Limited; Jacqueline C. Lui

(57) ABSTRACT

One example embodiment is a kitchen tray assembly that includes a T-shaped shaft and a plurality of trays movable within the T-shaped shaft. The T-shaped shaft includes a first horizontal compartment, a second horizontal compartment and a vertical compartment. The first and second horizontal compartments hold a number of tray receiving space, in which the number of tray receiving space is one less than a number of the trays in the kitchen tray assembly.

20 Claims, 15 Drawing Sheets

KITCHEN TRAY ASSEMBLY

FIELD OF THE INVENTION

The present invention relates to a kitchen tray assembly that moves storage trays through shafts in the assembly.

BACKGROUND

Different kinds of objects, from electronic appliances to cooking utensils, are stored in a kitchen. The objects are often stored in a way that is not easily accessible and retrievable. Further, these object can require significant storage space.

In view of the demand for efficiently storing objects, improvements in kitchen storage are desired.

SUMMARY OF THE INVENTION

Figure 1A:
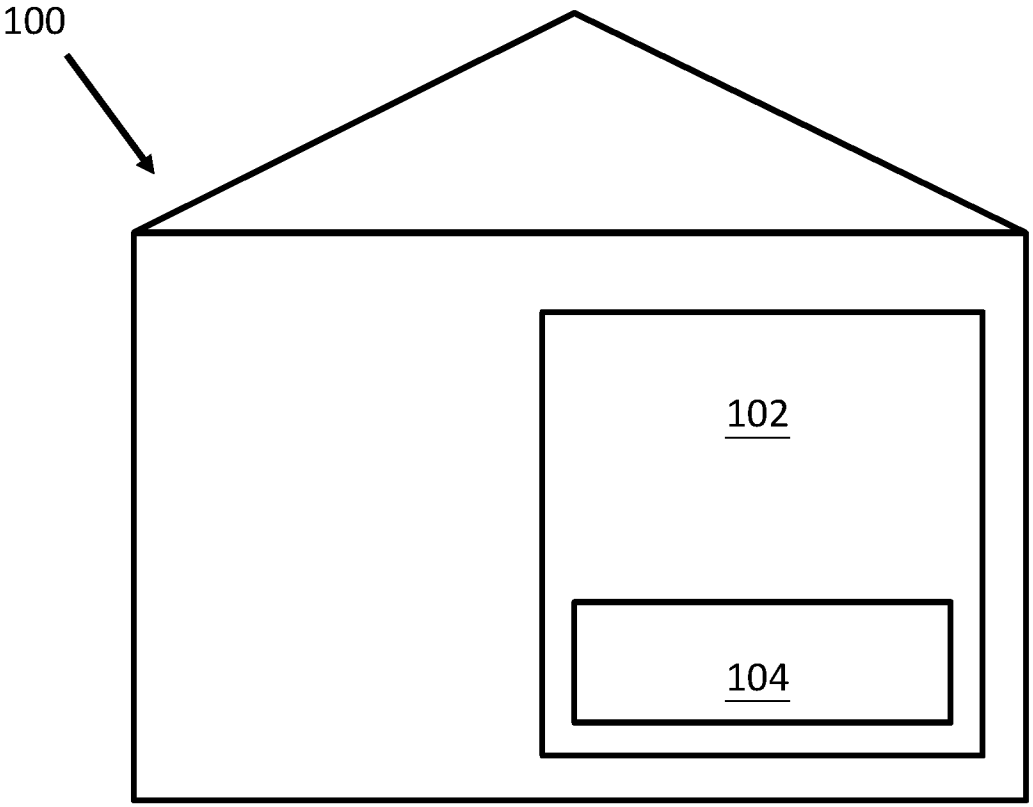
FIG. 1A shows a kitchen storage system installed in a structure or building in accordance with an example embodiment.

One example embodiment is a kitchen tray assembly that includes a T-shaped shaft and a plurality of trays movable within the T-shaped shaft. The T-shaped shaft includes a first horizontal compartment, a second horizontal compartment and a vertical compartment. The first and second horizontal compartments hold a number of tray receiving space, in which the number of tray receiving space is one less than a number of the trays in the kitchen tray assembly.

Other example embodiments are discussed herein.

DETAILED DESCRIPTION

Example embodiments relate to apparatus and methods that store and move objects in a kitchen tray assembly that includes a plurality of shafts for storing and moving the trays and the objects.

Kitchens are often constructed with a limited amount of storage space for food, appliances, and other items. Further, this storage space can be located in an inconvenient place, such as being too high to reach without standing on a stool or chair. Example embodiments solve these problems and other problems and provide a kitchen tray assembly or kitchen storage system that efficiently stores items in a kitchen or other storage location.

Another problem is that a user may not know where items are stored in a kitchen and may have to open drawers or cupboards while searching for the item. Example embodiments solve these problems since the kitchen tray assembly or kitchen storage system tracks locations of objects and provides this information to users, such as displaying this information to users while the users are located in the kitchen. This information can also be provided to and displayed on remote electronic devices, such as smartphones and other computers.

One example embodiment includes a motor that moves the trays within a T-shaped shaft, and a controller that connects with the motor to control movement of the trays within the shaft.

In one example embodiment, the T-shaped shaft includes a first horizontal compartment that is connected or adjacent to a ceiling of the kitchen, a second horizontal compartment that is connected or adjacent to the ceiling and aligned with the first horizontal compartment, and a vertical compartment that is connected or adjacent to a wall of the kitchen and connected to the first and second horizontal compartments to form the T-shaped shaft.

The first and second horizontal compartments include a plurality of trays that store and move objects located thereon and also include a plurality of empty spaces or tray receiving spaces that are sized and shaped to receive an empty tray or a tray with objects. The trays move through the shafts and into the tray receiving spaces so a user can selectively retrieve a desired tray. In one example embodiment, a number of tray receiving space is one less than a number of the trays in the kitchen tray assembly.

In an example embodiment, the first and second horizontal compartments include a track that forms a loop around which the objects in the kitchen move while in the T-shaped shaft. For example, the track can include runners, rails, grooves, or other pathways for moving the trays throughout the compartments. By way of example, the trays include or rest on one or more wheels or bearings that roll or glide along the tracks.

A user can control the trays with a control pad or a user interface. For example, a control pad or control display is located near or with the kitchen tray assembly. Further, the user can remotely control the trays. For example, the system includes a wireless receiver that receives commands from a handheld portable electronic device or HPED (such as a smartphone) and communicates the commands to the controller in order to remotely move the trays within the shafts.

An example embodiment also tracks and stores a location of trays and which objects are located on which trays. This storage information can be displayed on a user interface of the control pad and/or transmitted to a HPED for display. For instance, the user interface on the HPED provides a map or other visual indication of where the trays are located in the shafts and which objects are located on which trays.

FIG. 1A shows a structure or building 100 that includes a kitchen 102 in which a kitchen storage system 104 is installed in the kitchen 102.

Figure 1B:
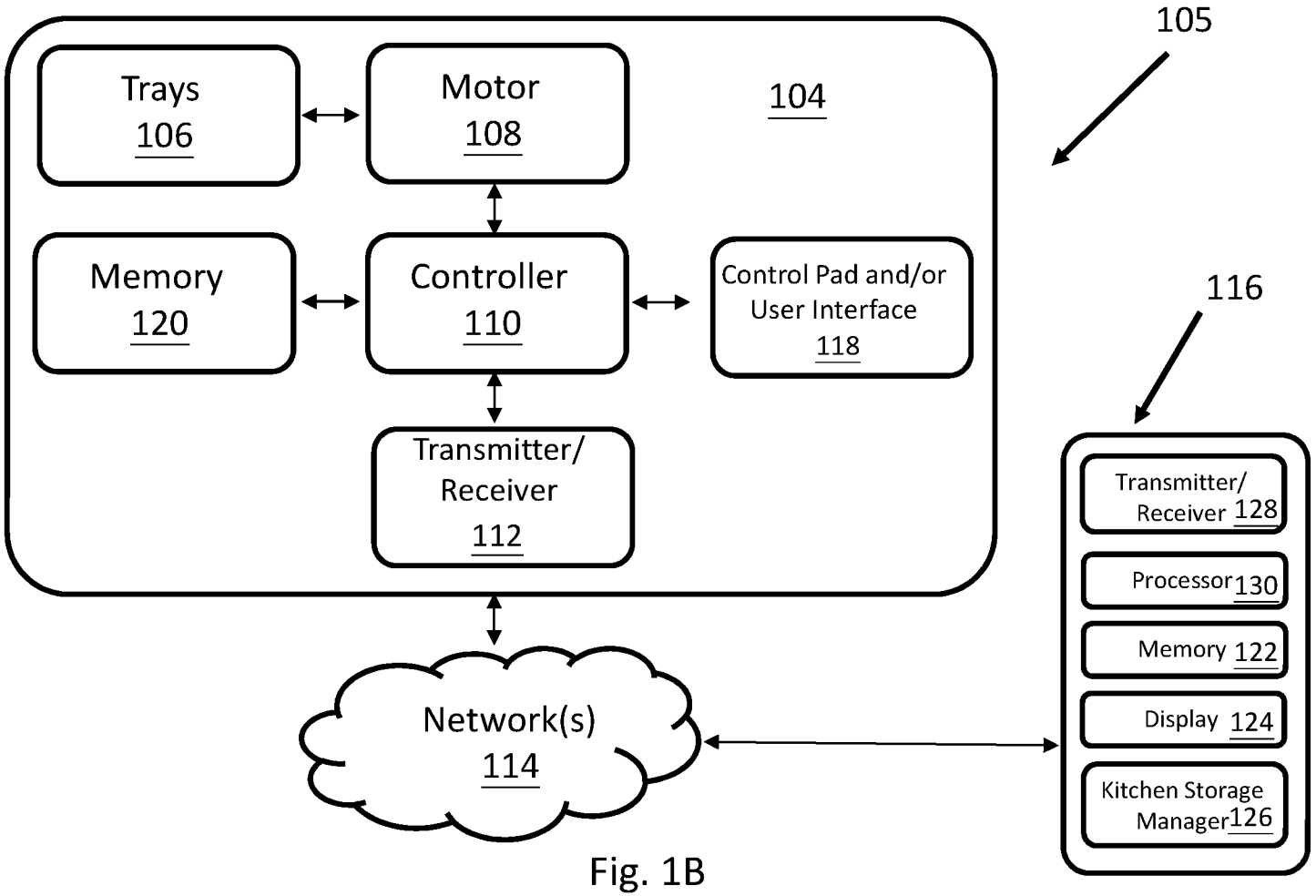
FIG. 1B shows an electronic system that includes the kitchen storage system of FIG. 1A in accordance with an example embodiment.

FIG. 1B shows an electronic system 105 that includes the kitchen storage system 104 that communicates with a hand-held portable electronic device (HPED) 116 via one or more a network(s) 114. In this example embodiment, the kitchen storage system 104 includes trays 106 on which objects can be stored, a motor 108 that moves the trays 106 within the kitchen storage system 104, a controller 110, a transmitter/receiver 112, a control pad and/or user interface 118, and a memory 120. The controller 110 communicates with the motor 108 and the transmitter/receiver 112 to control movement of the trays 106 within the kitchen storage system 104. The controller 110 also communicates with the control pad and/or user interface 118 and the memory 120.

The transmitter/receiver 112 wirelessly receives commands from the HPED 116 that move the trays 106 within the kitchen storage system 104. In one example embodiment, the transmitter/receiver 112 wirelessly transmits information on location of the trays 106 in the kitchen storage system 104 to the HPED 116. In an example embodiment, the transmitter/receiver 112 communicates the commands to the controller 110 in order to remotely move the trays 106 within the kitchen storage system 104.

The control pad and/or user interface 118 enables a user to communicate with the kitchen storage system 104, such as selecting any object stored on the tray 106 to retrieve or obtaining information of any objects or tray stored in the tray 106. The memory 120 stores an identity of the objects that are stored on the trays 106. In one example embodiment, the memory 120 stores which of the objects are stored on which of the trays 106. In an example embodiment, the memory 120 stores the identification of the objects and an identifier that corresponds to a tray on which an object is located, and records tray movement history.

The HPED 116 (such as a smartphone, a tablet computer, a laptop, or other computer) can include a memory 122, a display 124, a kitchen storage manager 126, a transmitter/receiver 128, and a processor 130. The memory 122 stores the information transmitted from the kitchen storage system 104.

The display 124 displays information, such as the information of the objects and the identifier. The kitchen storage manager 126 (such as a software application) enables the user to communicate with the kitchen storage system 104, such as making commands to retrieve a particular object(s) stored on the trays 106, and retrieving information of the objects stored on the trays 106. The transmitter/receiver 128 wirelessly transmits commands from the HPED to the kitchen storage system 104, and receives information stored in the kitchen storage system 104.

Figure 2:
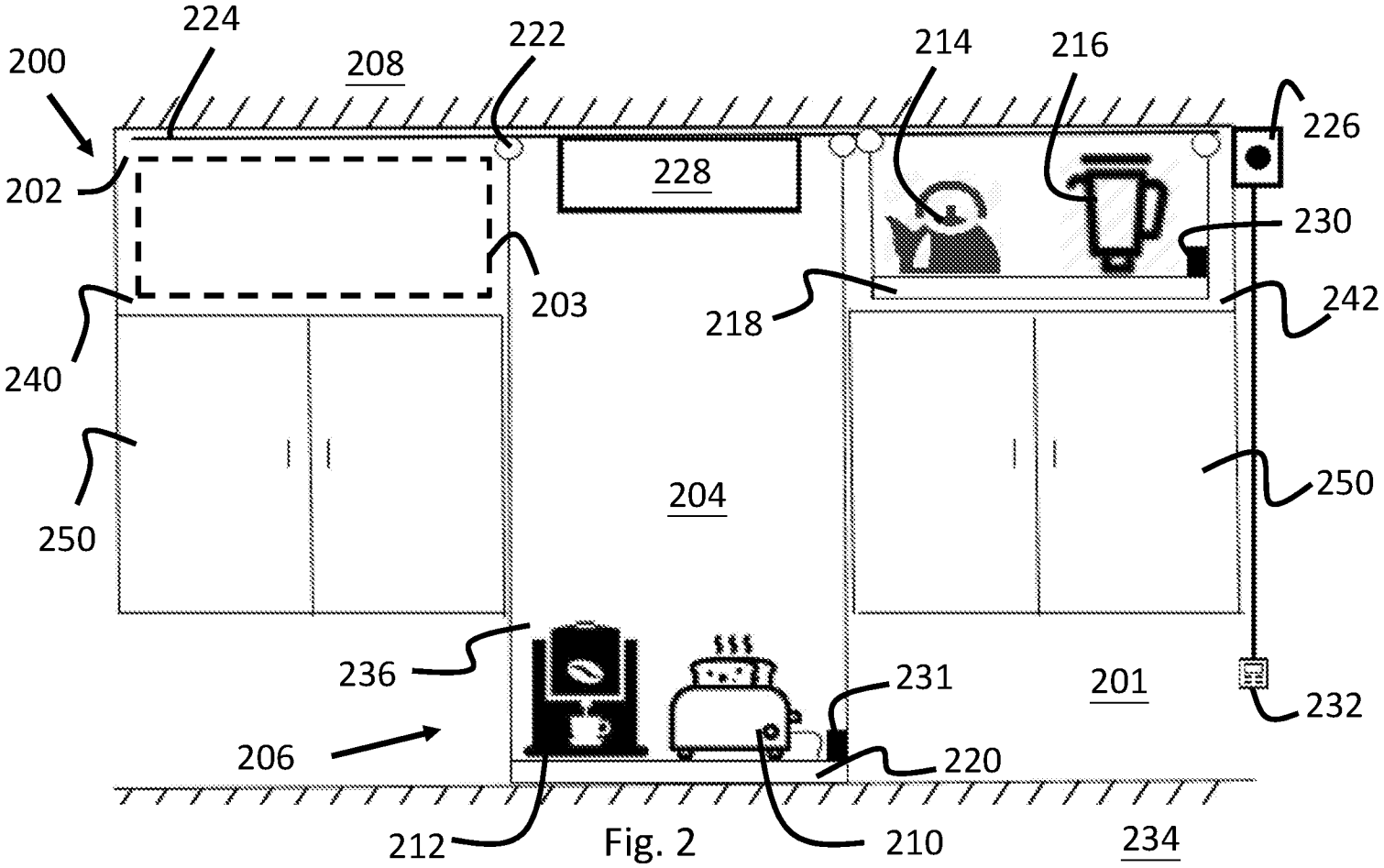
FIG. 2 shows a kitchen tray assembly in accordance with an example embodiment.

FIG. 2 shows a kitchen tray assembly (or a kitchen storage system) 200 in accordance with an example embodiment. The kitchen tray assembly 200 is installed in a kitchen 201 and stores and moves objects in the kitchen 201. The kitchen tray assembly 200 includes a rectangular shaped horizontal shaft 202 located adjacent and connected to a ceiling 208 in the kitchen 201, and an elongated vertical shaft 204 that connects to a wall of the kitchen 201 and to the horizontal shaft 202. The horizontal shaft 202 and the vertical shaft 204 form a T-shaped shaft 206, in which objects can travel through the T-shaped shaft 206.

The horizontal shaft 202 has a size that holds a number of trays (N) and includes a number of empty tray receiving space 203 (M), in a way that M is equal to N minus one and N is greater than one. By way of example, FIG. 2 shows two trays and one tray receiving space.

Objects can be stored on trays and transported through the kitchen tray assembly. As an example embodiment, a toaster 210 and a coffee maker 212 are stored on a tray 220, whereas a kettle 214 and a blender 216 are stored on a tray 218.

As an example embodiment, the trays include rollers or wheels 222 that roll along a path or track 224 that is formed along the horizontal shaft 202. As such, the trays can move within the T-shaped shaft 206 and along both the horizontal shaft 202. In one example embodiment, the track 224 forms a loop around which or through which the objects in the kitchen move while within the T-shaped shaft 206. The movement of the trays are powered by a motor 226.

The trays can be raised and lowered within the vertical shaft 204 through a lifting system such as a pulley assembly 228 as shown or another system, such as a periscope-type lifting system, motor and cable system, conveyor belt system, moving sidewalks, escalators, or other transport system.

As illustrated in FIG. 2, the tray 220 is lowered to a countertop 234 by the pulley assembly 228 so that the toaster 210 and the coffee maker 212 are placed in an opening in the vertical shaft 236 and accessible to a user. When a tray is not in use, it can be raised and stored in the horizontal shaft that is located above cupboards 250.

As an example embodiment, a sensor/reader 230 is installed on the tray 218 and senses an identification of the objects (i.e. the kettle 214 and the blender 216) stored on the tray 218. Another sensor/reader 231 is installed on the tray 220 to identify the toaster 210 and the coffee maker 212.

The sensor/reader detects and identifies the tray and objects on the tray using, by way of example, object recognition or object identification. For example, each tray and/or object on the tray has a unique identification or unique identifier that can be read by the sensor/reader. Examples of unique identifiers include, but are not limited to, a data tag or other tag that includes a unique tag value, a radio frequency identification (RFID), chip with encoded information, barcode, a near field communication (NFC) tag or device, readable magnetic strip, proximity card or device, contactless smart card or device, bokode, QR code, or other unique mechanical and/or electrical identifier.

The kitchen tray assembly 200 further includes a controller 232 that connects with the motor 226 and controls movement of the trays within the T-shaped shaft 206.

As another example embodiment, the horizontal shaft includes a first horizontal compartment 240 that is connected to the ceiling 208, and a second horizontal compartment 242 that is connected to the ceiling 208 and aligned with the first horizontal compartment 240. The vertical shaft includes a vertical compartment that is connected to the wall of the kitchen, and to the first horizontal compartment 240 and the second horizontal compartment 242. The first horizontal compartment 240 and the second horizontal compartment 242 have a rectangular shape and hold a number of empty tray receiving space 203, in which a number of the empty tray receiving space 203 is one less than a number of the trays in the kitchen tray assembly.

FIGS. 3A to 3E show a series of steps on the movement of a tray of a kitchen storage system 300 that includes two trays 306 and 308 and one tray receiving area 309. In this example embodiment, the number of empty spaces or tray receiving areas is one less than the number of trays.

Figure 3A:
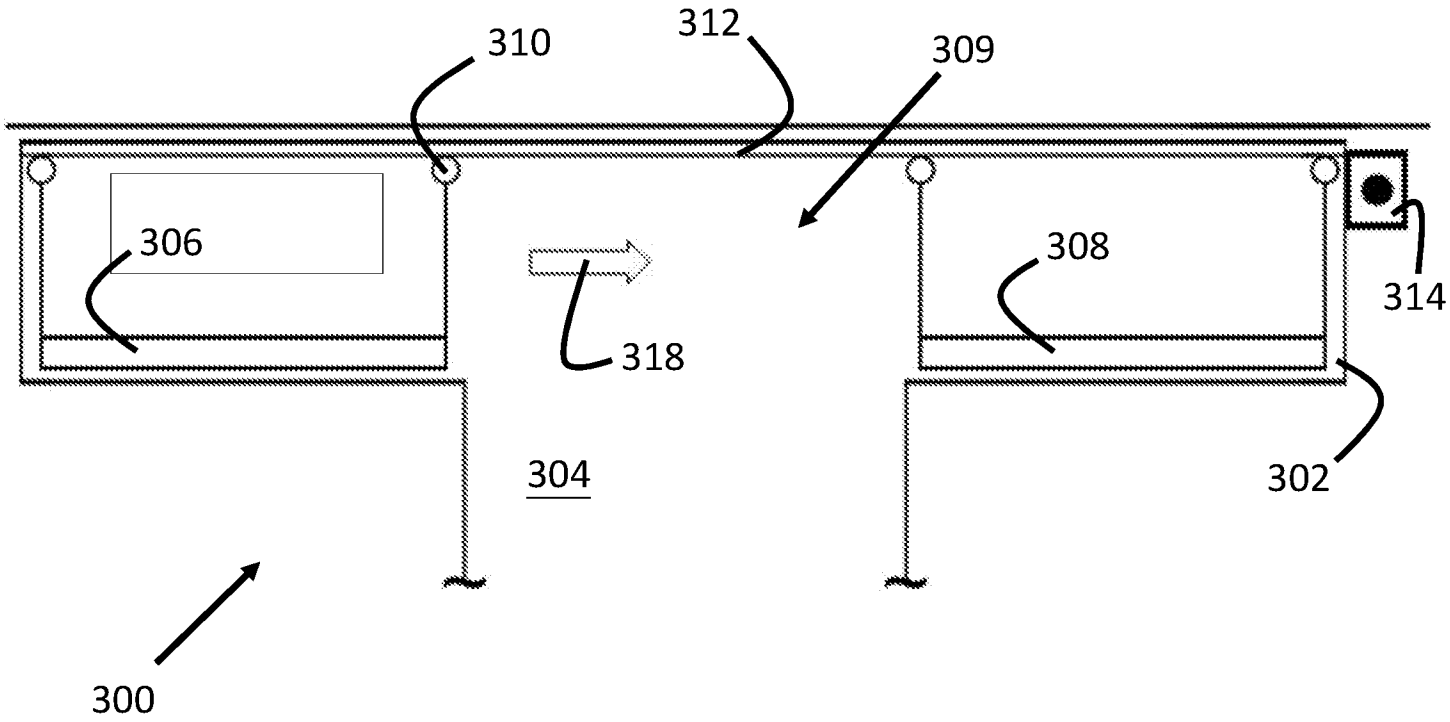
FIGS. 3A to 3E show a series of steps in which a tray moves from its original tray receiving space in a horizontal shaft to an open space in a vertical shaft, and then the tray returns to its original tray receiving space in the horizontal shaft from the open space in the vertical shaft of a kitchen storage system in accordance with an example embodiment.

In FIG. 3A, the kitchen storage system 300 includes a horizontal shaft 302 that houses a first tray 306, a second tray 308, the tray receiving area 309, and a vertical shaft 304. The horizontal shaft 302 and the vertical shaft 304 connect to form a T-shaped shaft as shown in the drawing. The first tray 306 has one or more rollers or wheels 310 that roll along a track 312 formed on the horizontal shaft 302, so that it can leave its original location and into the tray receiving space 309. Arrow 318 moves a direction of movement of the tray. The movement of the trays are powered by an electric motor 314.

Figure 3B:
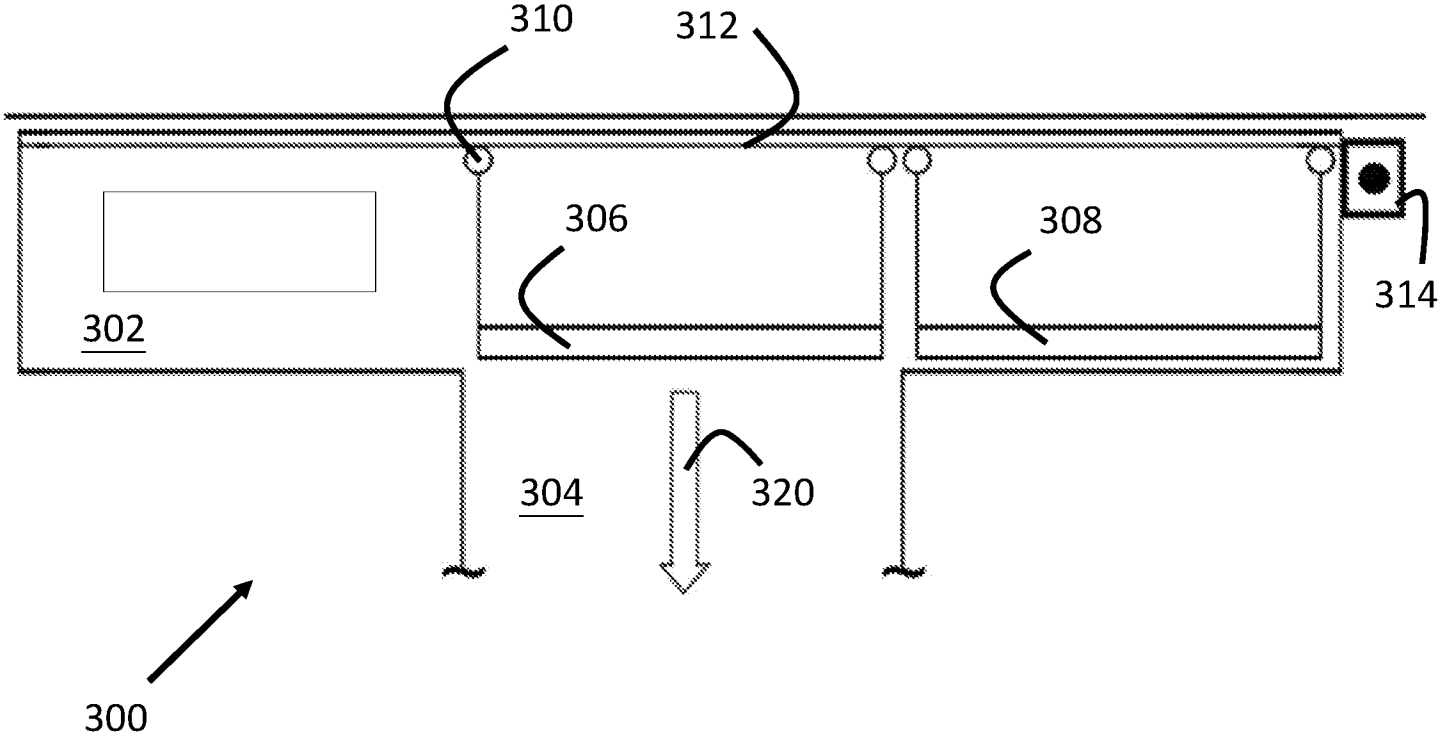

FIG. 3B shows that the first tray 306 is in the previous empty tray receiving space and is being lowered in the vertical shaft 304 along an arrow 320.

Figure 3C:
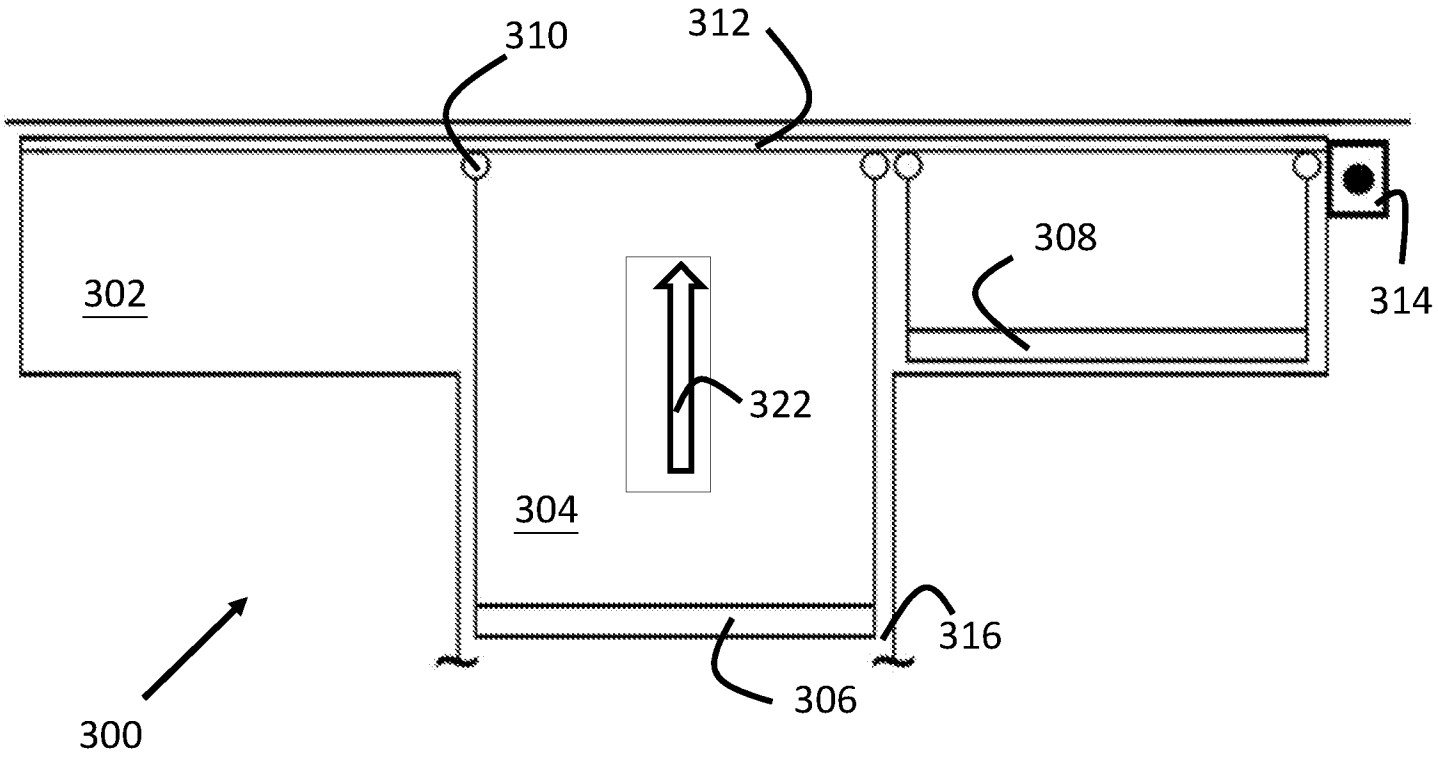

As shown in FIG. 3C, the first tray 306 is lowered to an opening of the vertical shaft 316 through a lifting system, and is then raised from the opening 316 back to the empty tray receiving space along an arrow 322.

Figure 3D:
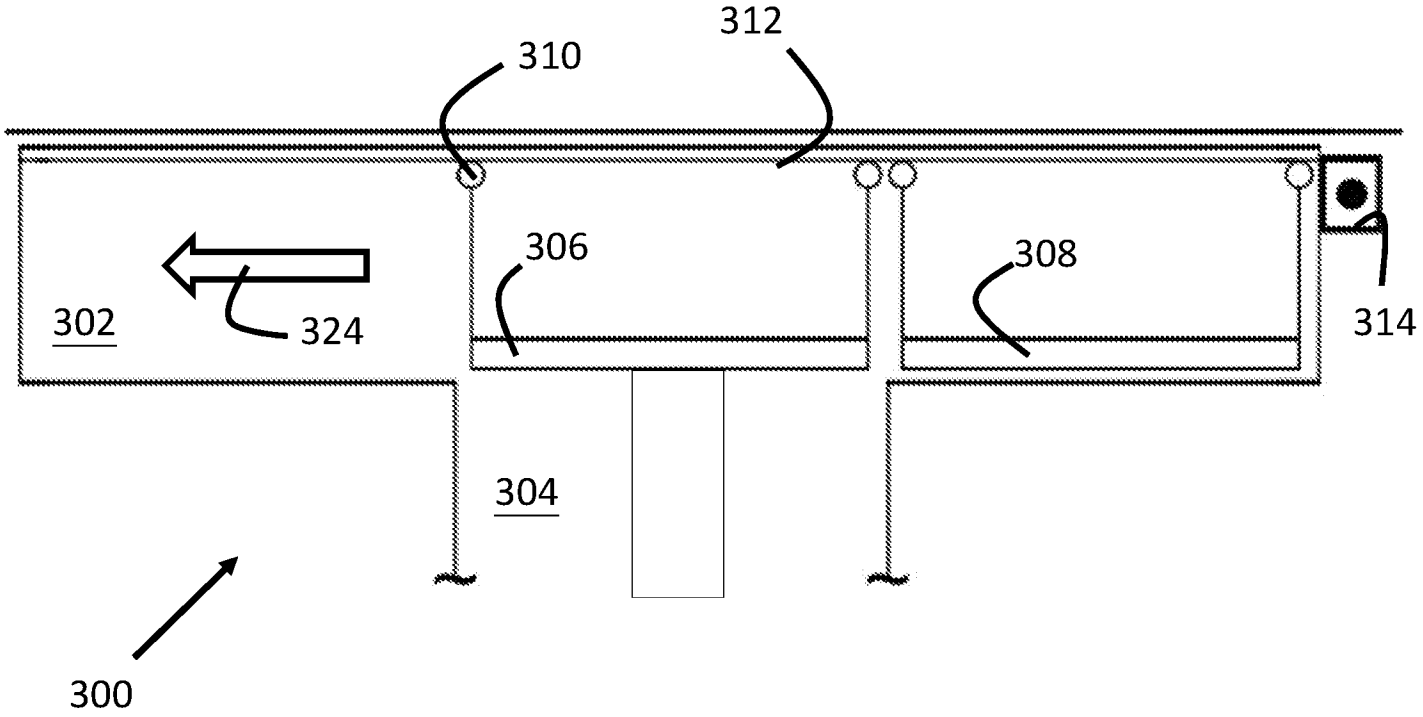
Figure 3E:
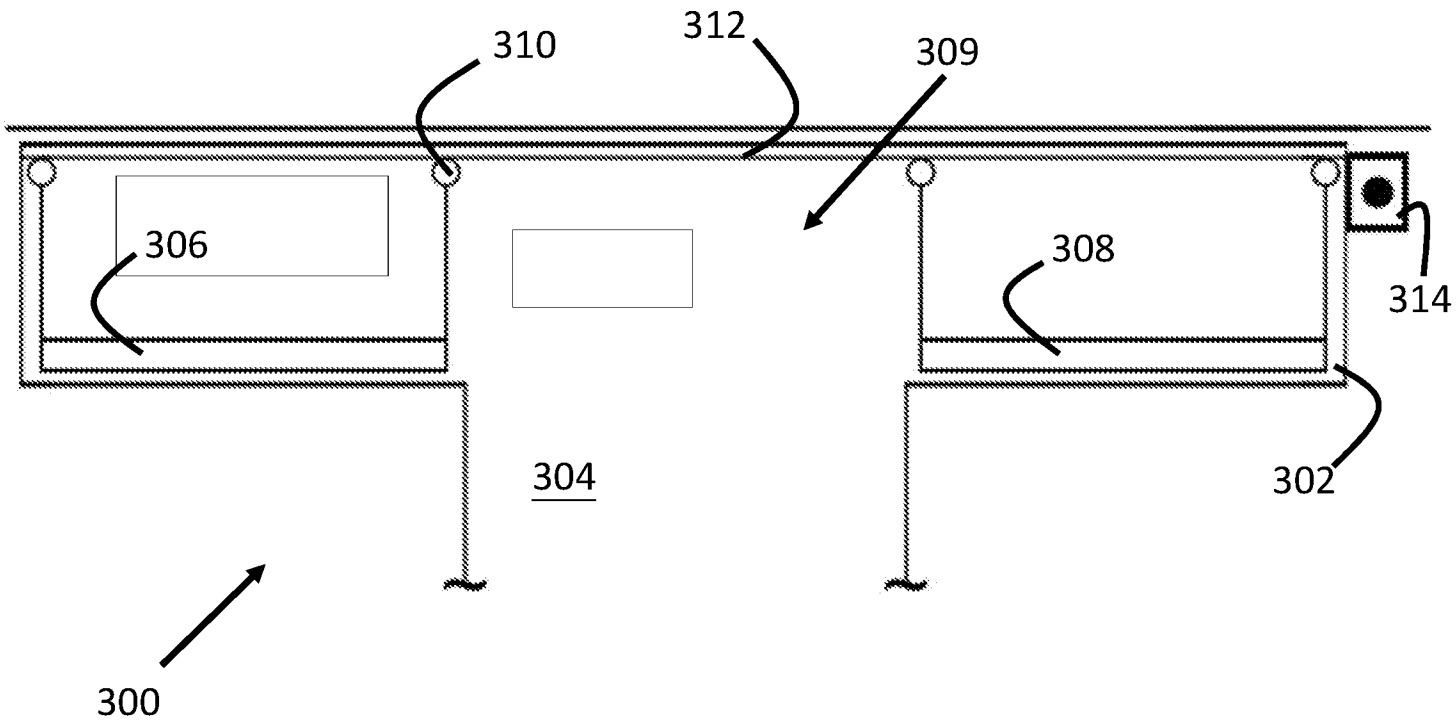

FIG. 3D shows that the tray 306 is in the previous empty tray receiving space and moves to its left to its original location along an arrow 324. Finally, the first tray 306 returns to its original location as shown in FIG. 3E.

Figure 3F:
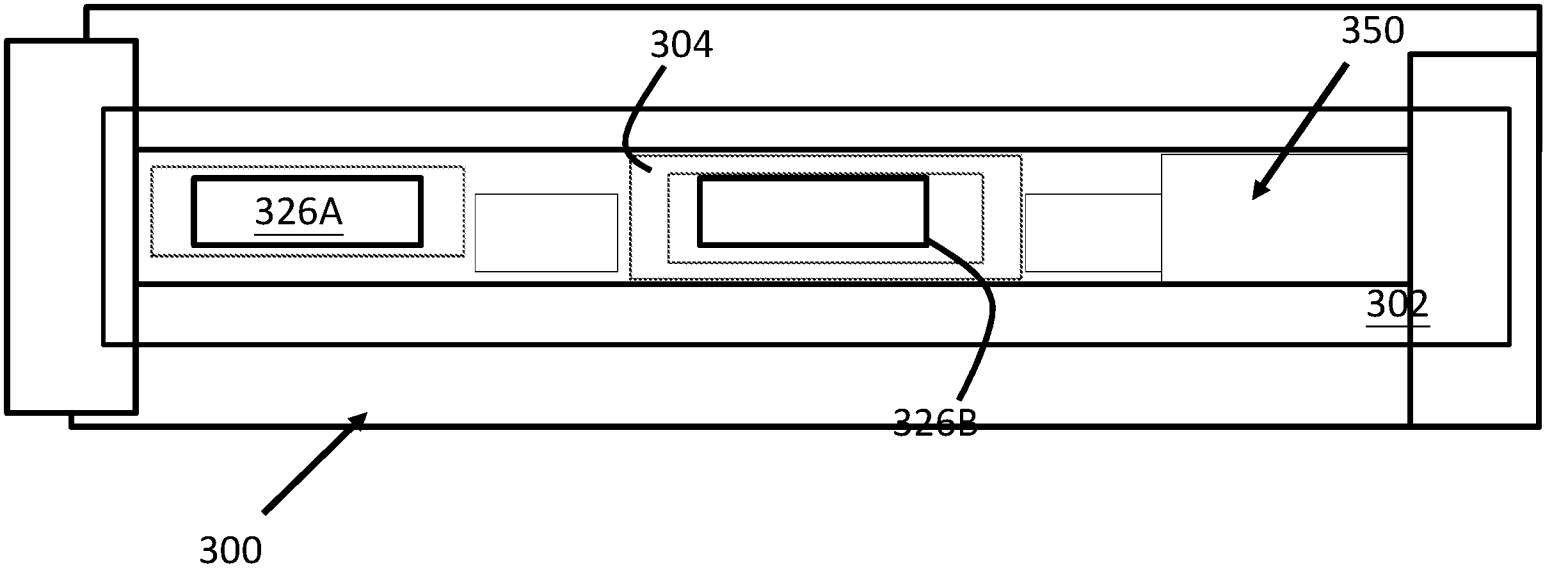
FIG. 3F shows a top view of the kitchen storage system with two trays and one empty tray receiving space in accordance with an example embodiment.

FIG. 3F shows a top view of the configuration of the kitchen storage system 300 with two trays stored and one empty tray receiving space. A first tray 326A is stored in its original tray receiving space in the horizontal shaft 302 while a second tray 326B is stored at the top of the vertical shaft. An empty tray receiving space 350 is located in the horizontal shaft and is available to receive either of the trays.

Figure 4:
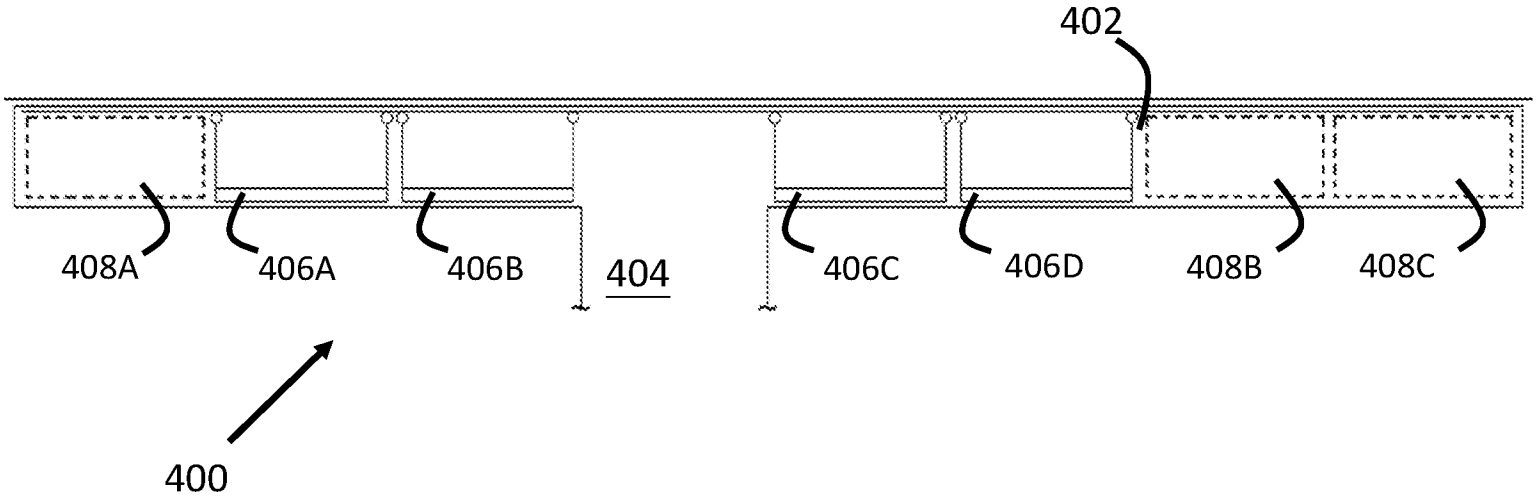
FIG. 4 shows a kitchen storage system with four trays in accordance with an example embodiment.

FIG. 4 shows another example embodiment of a kitchen storage system 400. In this configuration, there are four trays 406A, 406B, 406C and 406D stored in a horizontal shaft 402, and there are three empty tray receiving spaces 408A, 408B and 408C. The number of empty spaces (M) is equal to three and the number of trays (N) is equal to four.

Figure 5:
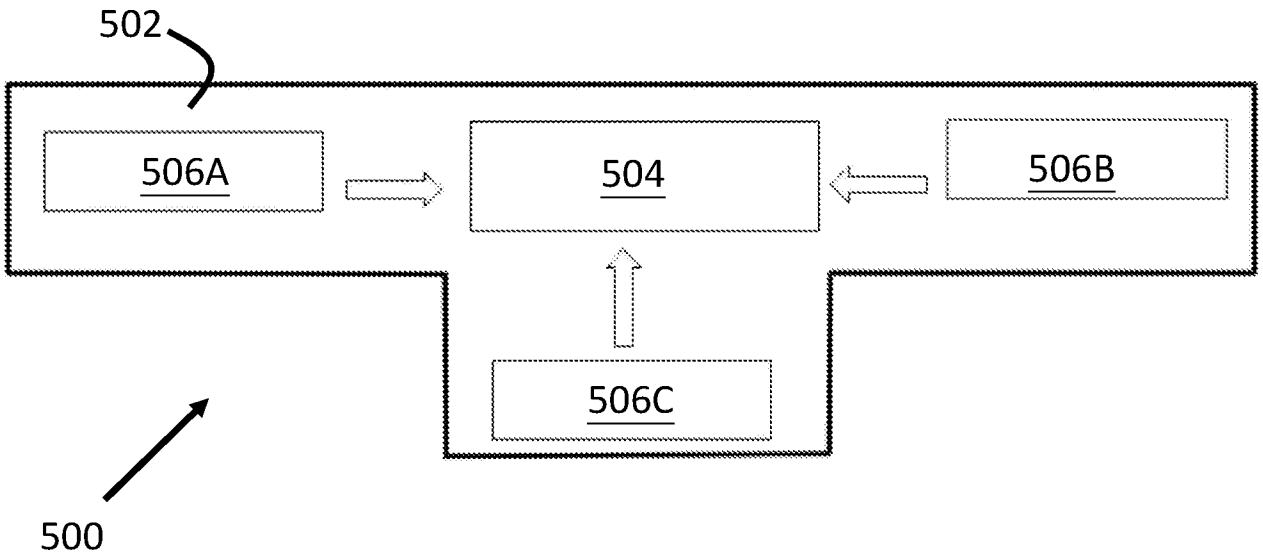
FIG. 5 shows a kitchen storage system with three trays in accordance with an example embodiment.

FIG. 5 shows a top view of a kitchen storage system 500. The kitchen storage system 500 includes a T-shaped horizontal shaft 502 and an elongated vertical shaft 504 that connect to form a T-shaped shaft. Three trays 506A, 506B and 506C are stored in the T-shaped horizontal shaft 502.

Figure 6:
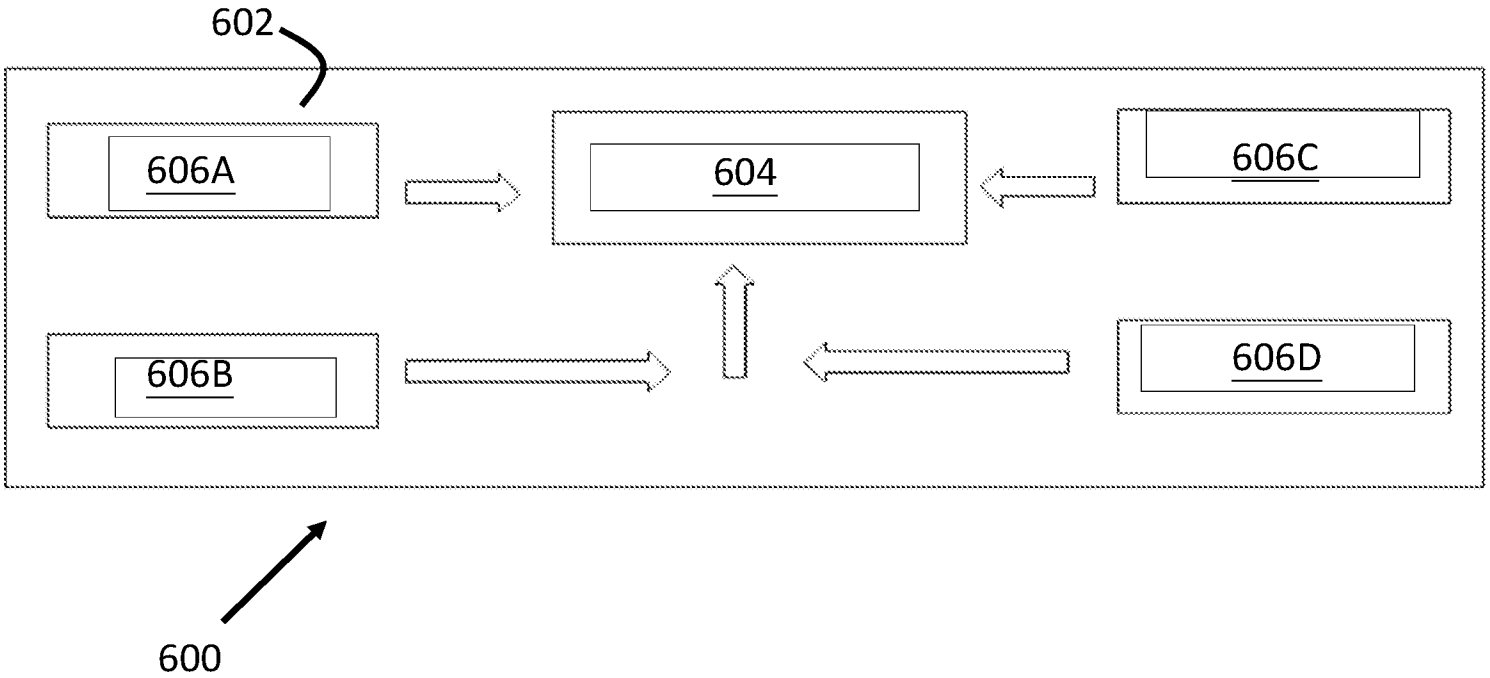
FIG. 6 shows a kitchen storage system with four trays in accordance with an example embodiment.

FIG. 6 shows a top view of a kitchen storage system 600. The kitchen storage system 600 includes a horizontal shaft 602 and an elongated vertical shaft 604 that connect to form at T-shaped shaft. Four trays 606A, 606B, 606C and 606D are stored in the horizontal shaft 602.

Figure 7:
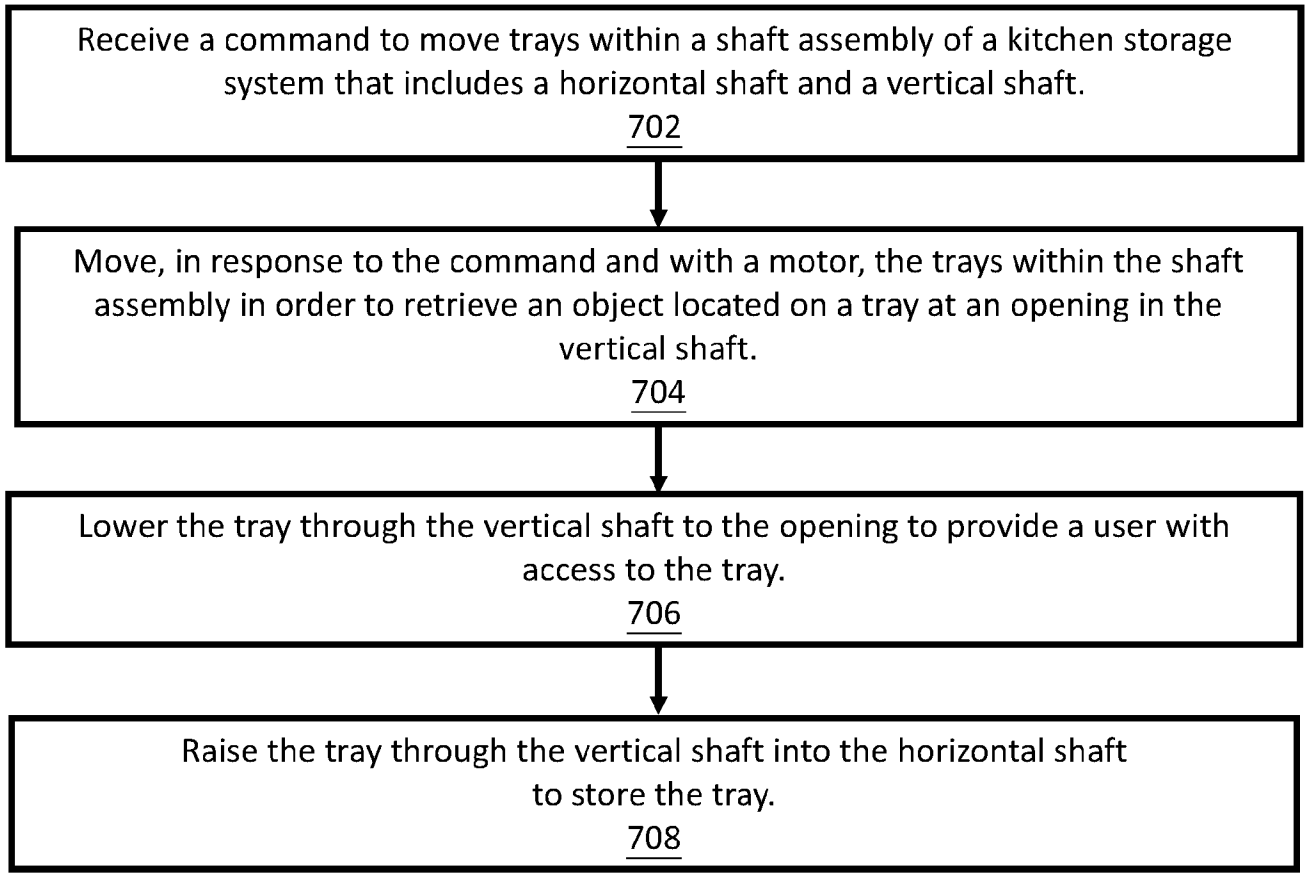
FIG. 7 shows a method of storing and moving objects in a kitchen with trays in a kitchen storage system in accordance with an example embodiment.

FIG. 7 shows a method of storing and moving objects in a kitchen with trays in a kitchen storage system. A command to move trays within a shaft assembly of the kitchen storage system is received 702. The shaft assembly includes an elongated vertical shaft that connects to a horizontal shaft located adjacent to a ceiling in the kitchen such that the vertical and horizontal shafts connect to form a T-shaped shaft through which the objects travel. The trays, in response to the command and with a motor, move within the shaft assembly in order to retrieve an object located on a tray at an opening in the vertical shaft, in which the opening is located adjacent a countertop in the kitchen 704. The tray is lowered through the vertical shaft to the opening to provide a user with access to the tray 706. The tray is raised through the vertical into the horizontal shaft to store the tray 708.

Figure 8:
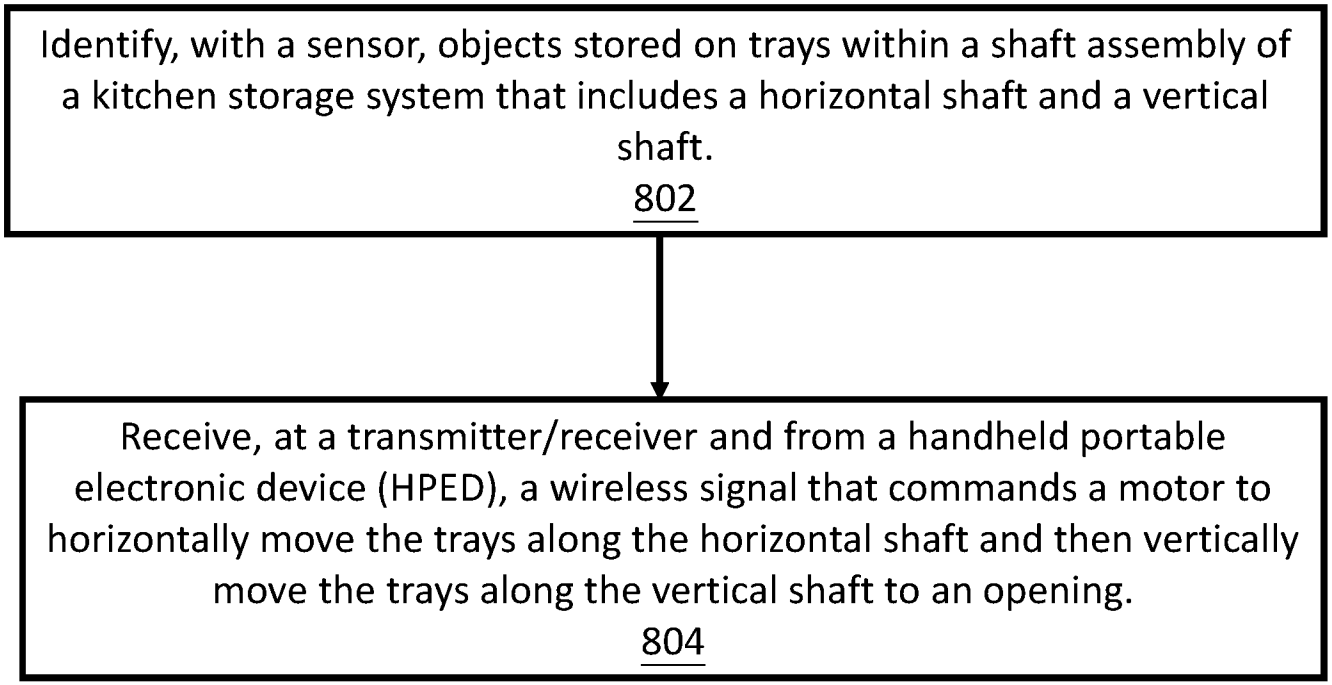
FIG. 8 shows a method of storing and moving objects in a kitchen with trays in a kitchen storage system in accordance with an example embodiment.

FIG. 8 shows a method in which the objects stored on the trays within a shaft assembly of a kitchen storage system are identified with a sensor, in which the shaft assembly includes a horizontal shaft and a vertical shaft per 802. A wireless transmitter/receiver receives, from a handheld portable electronic device (HPED), a wireless signal that commands a motor to horizontally move the trays along the horizontal shaft and then vertically move the trays along the vertical shaft to an opening per 804.

Figure 9:
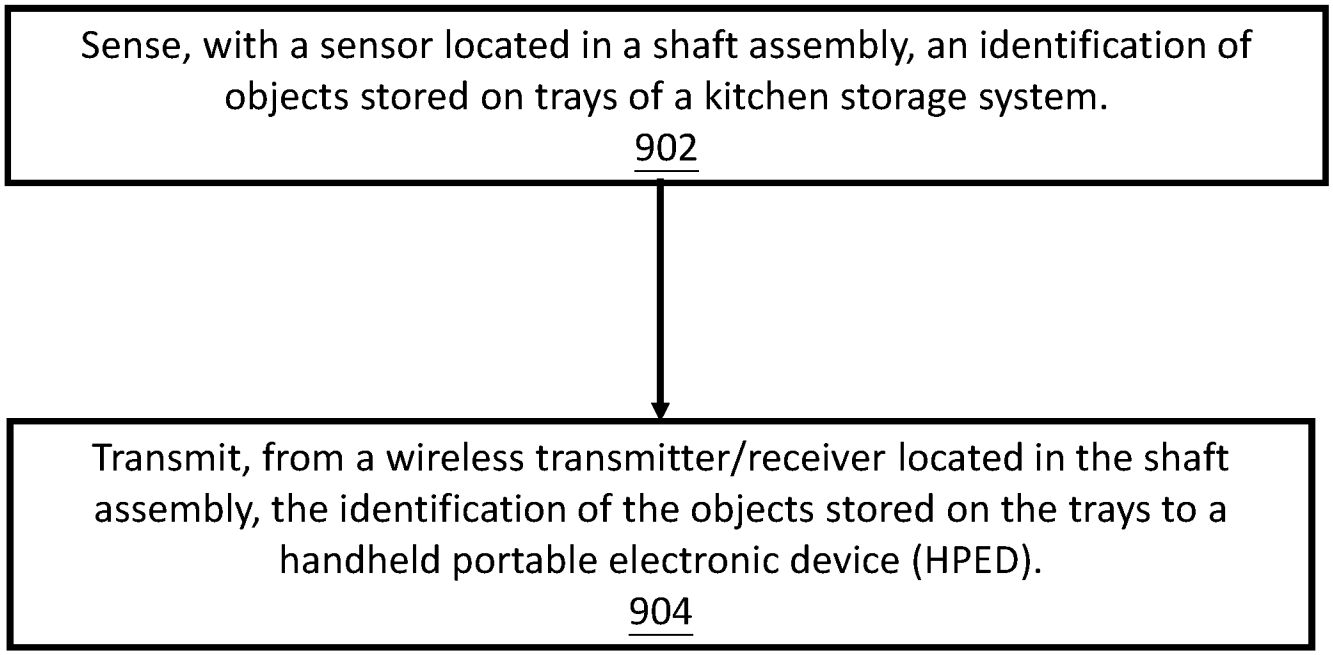
FIG. 9 shows a method of sensing an identification of objects stored on trays of a kitchen storage system and transmitting the identification to a handheld portable electronic device (HPED) in accordance with an example embodiment.

FIG. 9 shows a method in which an identification of objects stored on trays of a kitchen storage system is sensed with a sensor located in a shaft assembly 902. The identification of the objects stored on the trays is transmitted, from a wireless transmitter/receiver located in the shaft assembly, to a handheld portable electronic device (HPED) 904.

As used herein, a "building" is an enclosed structure with a roof and walls standing in a place. Examples of a building include, but are not limited to, residential house, warehouse, factory, storage facility, and hospital.

As used herein, a "wireless transmission" is the transmission of information between two points not connected by an electrical connector. Examples of wireless transmission include, but not limited to, wi-fi transmission, Bluetooth transmission, radio frequency (RF) transmission, infrared (IR) transmission and 3rd generation (3G) or 4th generation (4G) of mobile telecommunications technology.

What is claimed is:

1. A kitchen tray assembly that stores and moves objects in a kitchen, the kitchen tray assembly comprising:
   - a T-shaped shaft that includes a first horizontal compartment connected to a ceiling of the kitchen, a second horizontal compartment connected to the ceiling and aligned with the first horizontal compartment, and a vertical compartment connected to a wall of the kitchen and to the first and second horizontal compartments to form the T-shaped shaft;
   - a plurality of trays movable within the T-shaped shaft;
   - a motor that moves the trays within the T-shaped shaft; and
   - a controller that connects with the motor and controls movement of the trays within the T-shaped shaft,
   - wherein the first and second horizontal compartments hold a number of tray receiving space, in which the number of tray receiving space is one less than a number of the trays in the kitchen tray assembly.

2. The kitchen tray assembly of claim 1, wherein the first and second horizontal compartments include a track that forms a loop around which the objects in the kitchen move while in the T-shaped shaft.

3. The kitchen tray assembly of claim 1 further comprising:
   - a pulley assembly that raises and lowers the trays in the vertical compartment.

4. The kitchen tray assembly of claim 1 further comprising:
   - tracks formed along the first and second horizontal compartments, wherein the trays include wheels that roll along the tracks.

5. The kitchen tray assembly of claim 1, wherein the vertical compartment and the first and second horizontal compartments have a rectangular shape.

6. The kitchen tray assembly of claim 1 further comprising:
   - a wireless receiver that receives commands from a smartphone and communicates the commands to the controller in order to remotely move the trays within the T-shaped shaft.

7. The kitchen tray assembly of claim 1 further comprising:
   - a memory that stores which of the objects are located on which of the trays.

8. A kitchen storage system that stores objects in a kitchen, the kitchen storage system comprising:
   - a shaft assembly that includes an elongated vertical shaft that connects to a horizontal shaft located adjacent to a ceiling in the kitchen such that the vertical and horizontal shafts connect to form a T-shape shaft through which the objects travel;

trays that move within the T-shaped shaft and along both the vertical and horizontal shafts;

a motor that moves the trays within the T-shaped shaft and along both the vertical and horizontal shafts;

a wireless receiver that receives, from a smartphone, commands that move the trays within the T-shaped shaft and along both the vertical and horizontal shafts;

a memory that stores an identity of the objects that are located on the trays; and a controller that communicates with the motor, the wireless receiver, and the memory to control movement of the trays within the T-shaped shaft and along both the vertical and horizontal shafts, wherein the horizontal shaft has a size that holds a number of trays (N) and includes a number of empty tray receiving spaces (M) such that M is equal to N minus one and N is greater than one.

9. The kitchen storage system of claim 8 further comprising:

a pulley assembly that connects to the motor and raises and lowers the trays in the vertical compartment.

10. The kitchen storage system of claim 8 further comprising:

wheels on the trays; and tracks formed along the horizontal shaft that receive the wheels that roll along the tracks.

11. The kitchen storage system of claim 8 further comprising:

a wireless transmitter/receiver that transmits information on location of the objects in the kitchen storage system to the smartphone.

12. The kitchen storage system of claim 8 further comprising:

a sensor that senses an identification of the objects stored in the kitchen storage system, wherein the memory stores the identification and an identifier that corresponds to a tray on which an object is located.

13. The kitchen storage system of claim 8, wherein the horizontal shaft include a track that forms a loop around which the objects in the kitchen move while within the T-shaped shaft.

14. The kitchen storage system of claim 8, wherein M is equal to one and N is equal to two when two trays are stored in the horizontal shaft.

15. The kitchen storage system of claim 8, wherein M is equal to three and N is equal to four when four trays are stored in the horizontal shaft.

16. A method of storing and moving objects in a kitchen with trays in a kitchen storage system, the method comprising:

receiving, at a control pad, commands to move the trays within a shaft assembly that includes an elongated vertical shaft that connects to a horizontal shaft located adjacent to a ceiling in the kitchen such that the vertical and horizontal shafts connect to form a T-shaped shaft through which the objects travel; and moving, in response to the commands and with a motor, the trays within the shaft assembly and through the horizontal and vertical shafts in order to retrieve an object located on a tray at an opening in the vertical shaft that is located adjacent a countertop in the kitchen.

17. The method of claim 16 further comprising:

lowering the tray through the vertical shaft to the opening to provide a user with access to the tray; and raising the tray through the vertical shaft and into the horizontal shaft to store the tray.

18. The method of claim 16 further comprising:

identifying, with a sensor, the objects stored on the trays.

19. The method of claim 16 further comprising:

receiving, at the control pad and from a smartphone, a wireless signal that commands the motor to horizontally move the tray along the horizontal shaft and then vertically move the tray along the vertical shaft to the opening.

20. The method of claim 16 further comprising:

sensing, with a sensor located in the shaft assembly, an identification of the objects stored on the trays;

transmitting, from a wireless transmitter/receiver located in the shaft assembly, the identification of the objects stored on the trays to a smartphone.

* * * * *